US005452578A

United States Patent [19]

Barber

[11] Patent Number: 5,452,578

[45] Date of Patent: Sep. 26, 1995

[54] EXHAUST CUTOUT DEVICE

[76] Inventor: Dale Barber, 171 Old Country Rd., Crockett, Calif. 94525

[21] Appl. No.: 199,491

[22] Filed: Feb. 22, 1994

[51] Int. Cl.[6] ..... F01N 7/00

[52] U.S. Cl. ..... 60/324; 181/236; 181/254

[58] Field of Search ..... 60/324, 288; 181/236, 181/254

[56] References Cited

U.S. PATENT DOCUMENTS 1,503,918 8/1924 Ruby ..... 60/324

2,488,563 11/1949 Sills ..... 60/324

*Primary Examiner*—Douglas Hart

*Attorney, Agent, or Firm*—Michael I. Kroll

[57] ABSTRACT

An improved exhaust cutout device is provided for an engine having a collector pipe from a header and an exhaust pipe to a muffler. The device consists of a mechanism for diverting exhaust gases. Elements are for fluidly coupling the diverting mechanism between the collector pipe and the exhaust pipe. A structure is for operating the diverting mechanism. In a first operable position, the exhaust gases can pass between the collector pipe and the exhaust pipe to pass through the muffler for a quiet exhaust for city and restricted areas. In a second operable position, the exhaust gases can exit directly into the atmosphere for open road, racing purposes and country driving when more speed, more power and gas economy is required.

1 Claim, 2 Drawing Sheets

EXHAUST CUTOUT DEVICE

BACKGROUND OF THE INVENTION

1. Field of the Invention

The instant invention relates generally to apparatuses for selectively discharging exhaust gases from engines or power plants and more specifically it relates to an improved exhaust cutout device.

2. Description of the Prior Art

Numerous selectively discharging apparatuses for exhaust gases have been provided in prior art. For example, U.S. Pat. Nos. 922,563 to Chadwick; 1,794,642 to Hadford and 4,920,747 to Haney all are illustrative of such prior art. While these units may be suitable for the particular purpose to which they address, they would not be as suitable for the purposes of the present invention as heretofore described.

Chadwick, Lee S.

MUFFLER CUT-OUT MECHANISM

U.S. Pat. No. 922,563

In a motor car having a plurality of cylinders, an exhaust manifold is provided common to all the cylinders and is connected thereto. A muffler is connected with the manifold. The manifold has discharge ports substantially opposite to the exhaust ports of an engine, whereby the cylinders may exhaust directly into the atmosphere. Valves are for closing the discharge ports in the manifold.

Hadford, William H.

EXHAUST-PIPE CONSTRUCTION

U.S. Pat. No. 1,794,642

In internal combustion engine an exhaust-pipe construction is provided, comprising a conduit having a plurality of apertures opening in materially different directions. A pipe plug is adapted to fit interchangeably in either of the apertures, while a pipe is adapted to fit the other aperture.

Haney, Billy L.

HEADER DUMP ASSEMBLY

U.S. Pat. No. 4,920,747

A header dump assembly comprising an inlet port, an exhaust port and a bypass port disposed between the inlet port and the exhaust port. The bypass port may be selectively sealed with a closure assembly to route the exhaust gases from an exhaust manifold to a muffler to reduce engine noise. The closure assembly may be removed to allow exhaust gasses to bypass the muffler to reduce back pressure and improve engine performance. The closure assembly may be installed upon the bypass port and sealed thereon with less than one rotation of the handle. Alternately, the closure assembly may be removed from the bypass port with less than one reverse rotation of the handle.

SUMMARY OF THE INVENTION

A primary object of the present invention is to provide an improved exhaust cutout device that will overcome the shortcomings of the prior art devices.

Another object is to provide an improved exhaust cutout device that will divert exhaust gases directly into the atmosphere from an exhaust system to bypass a muffler when more performance is desired, thereby reducing exhaust back pressure.

An additional object is to provide an improved exhaust cutout device that is constructed to be operated by an actuating unit, so that when the exhaust gases are diverted into the atmosphere more speed, more power and gas economy is produced.

A further object is to provide an improved exhaust cutout device that is simple and easy to use.

A still further object is to provide an improved exhaust cutout device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
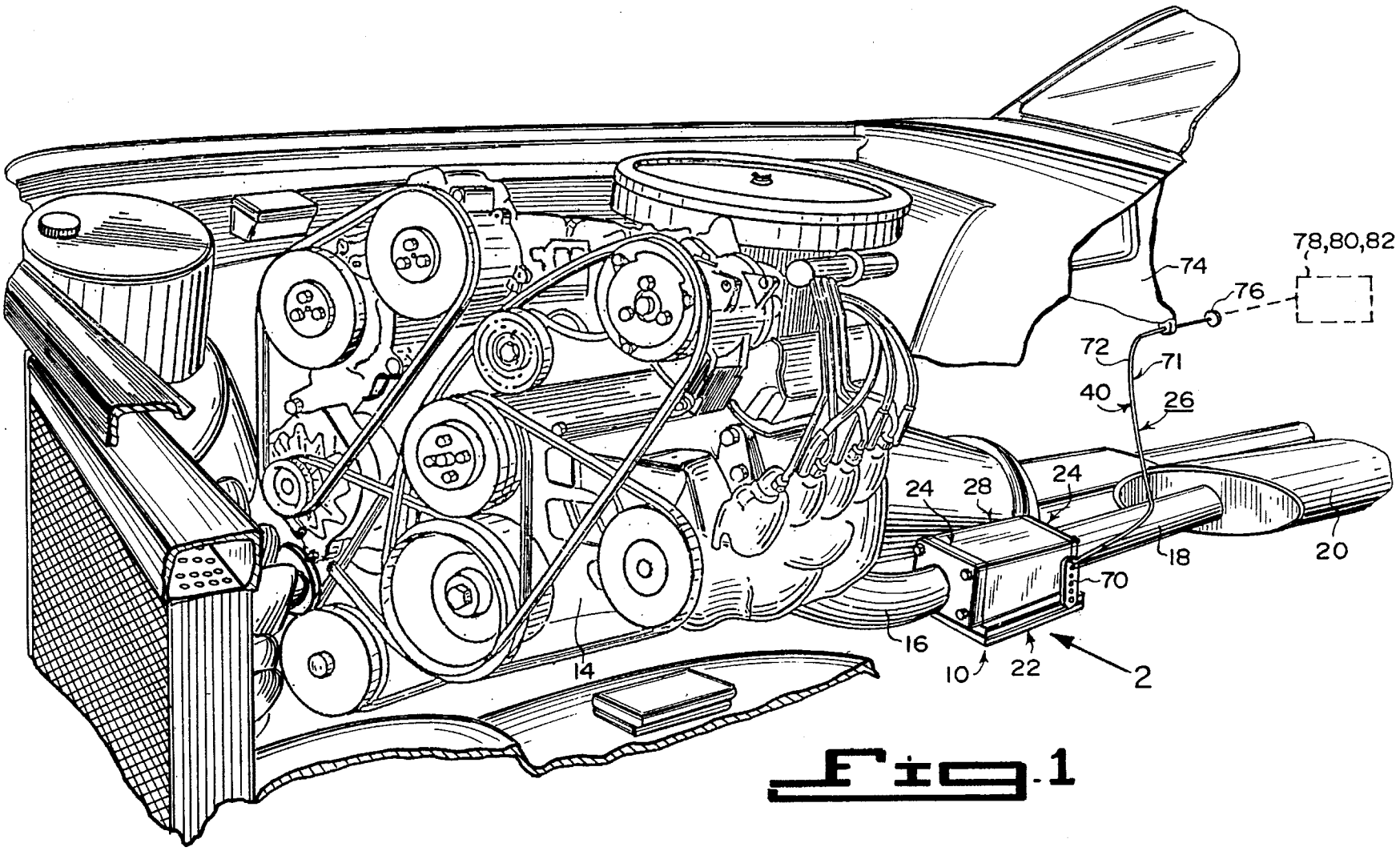
FIG. 1 is a perspective view the instant invention installed in an exhaust system.
Figure 2:
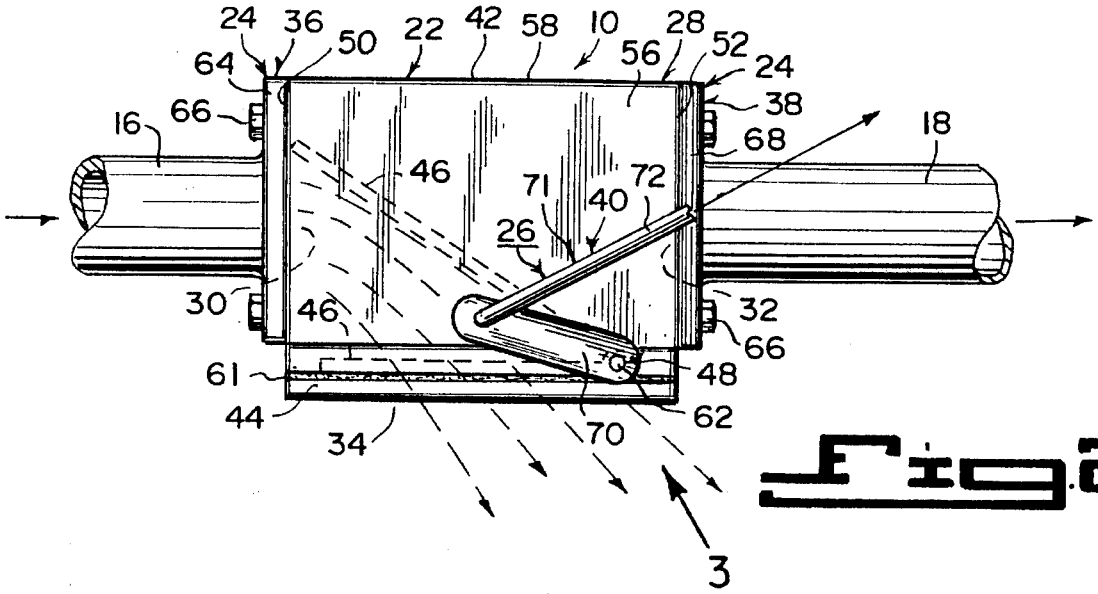
FIG. 2 is an enlarged side view taken in direction of arrow 2 in FIG. 1, with the collector pipe and exhaust pipe broken away.
Figure 3:
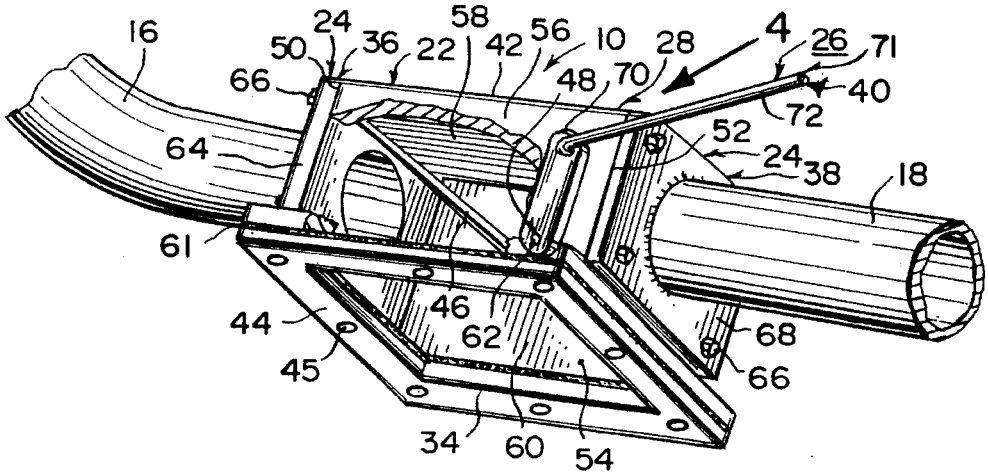
FIG. 3 is a bottom perspective view taken in the direction of arrow 3 in FIG. 2, with the housing broken away.
Figure 4:
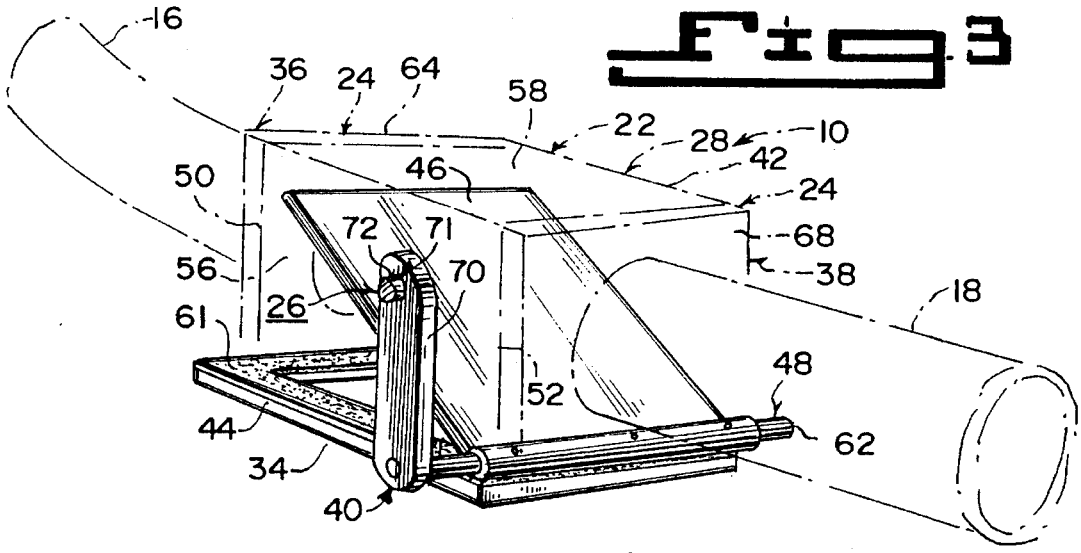
FIG. 4 is a top perspective view taken in the direction of arrow 4 in FIG. 3, showing the housing, mounting flanges, collector pipe and exhaust pipe all in phantom.

Turning now descriptively to the drawings, in which similar reference characters denote similar elements throughout the several views, FIGS. 1 through 4 illustrate an improved exhaust cutout device 10 for an engine 14 having a collector pipe 16 from a header and an exhaust pipe 18 to a muffler 20. The device 10 consists of a mechanism 22 for diverting exhaust gases. Elements 24 are for fluidly coupling the diverting mechanism 22 between the collector pipe 16 and the exhaust pipe 18. A structure 26 is for operating the diverting mechanism 22.

In a first operable position, the exhaust gases can pass between the collector pipe 16 and the exhaust pipe 18 to pass through the muffler 20, for a quiet exhaust for city and restricted areas. In a second operable position, the exhaust gases can exit directly into the atmosphere for open road, racing purposes and country driving when more speed, more power and gas economy is required.

The diverting mechanism 22 is a valve assembly 28, having an inlet port 30, an outlet port 32 and a bypass port 34. The coupling elements 24 include a first mounting component 36 on the collector pipe 16 connected to the valve assembly 28 at the inlet port 30. A second mounting component 38 on the exhaust pipe 18 is connected to the valve assembly 28 at the outlet port 32. The operating structure 26 is an actuating unit 40 to operate the valve assembly 28.

The valve assembly 28 consists of a housing 42 having the inlet port 30 and the outlet port 32 and an open underside. A frame 44 is connected by fasteners 45 about the open underside of the housing 42 forming the bypass port 34. A diverter plate 46 is provided. An apparatus 48 is for pivoting the diverter plate 46 within the housing 42. When the diverter plate 46 is in the first operable position down against the frame 44 sealing off the bypass port 34, the exhaust gases will pass through the housing 42 from the inlet port 30 to the outlet port 32. When the diverter plate 46 is in the second operable position opened away from the frame 44 exposing the bypass port 34, the exhaust gases will be deflected by the diverter plate 46 outwardly through the bypass port 34 in the frame 44.

The housing 42 is box-shaped and includes a first side wall 50 having the inlet port 30 therethrough. A second side wall 52 has the outlet port 32 therethrough. A back wall 54 extends between the first and second side wall 50, 52. A front wall 56 extends between the first and second side walls 50, 52. A top wall 58 extends over the first side wall 50, the second side wall 52, the back wall 54 and the front wall 56, forming a chamber 60 therein with an open bottom.

A gasket seal seat 61 is between the open underside of the housing 42 and the frame 44. When the diverter plate 46 is in the first operable position, the gasket seal seat 61 will prevent leakage of the exhaust gases therefrom. The pivoting apparatus 48 is a shaft 62 extending through a lower corner of the back wall 54, one side of the diverter plate 46 and the front wall 56 adjacent the second side wall 52 of the housing 42.

The first mounting component 36 consists of a first flange 64 secured to an end of the collector pipe 16. A plurality of bolts 66 extend through the first flange 64 and into the first side wall 50 of the housing 42. The second mounting component 38 consists of a second flange 68 secured to an end of the exhaust pipe 18. A plurality of the bolts 66 extend through the second flange 68 and into the second side wall 52 of the housing 42.

The actuating unit 40 includes a lever 70 connected at a first side to one end of the shaft 62. A mechanism 71 is for moving the lever 70, so that the turning of the shaft 62 will cause the diverter plate 46 to travel between the first and second operable positions. The moving mechanism 71 can consist of elongated cable 72 extending from a second side of the lever 70 to a dashboard 74. A control knob 76 will be on a distal end of the cable 72 at the dashboard 74, so that a person can operate the diverter plate 46 by manually sliding the control knob 76 in and out.

The moving mechanism 71 can also be an electric actuator 78, an hydraulic actuator 80 and an air actuator 82.

LIST OF REFERENCE NUMBERS

10 improved exhaust cutout device
14 engine
16 collector pipe
18 exhaust pipe
20 muffler
22 diverting mechanism
24 coupling element
26 operating structure
28 valve assembly for 22
30 inlet port
32 outlet port
34 bypass port
36 first mounting component
38 second mounting component
40 actuating unit for 26
42 housing
44 frame
45 fastener
46 diverter plate
48 pivoting apparatus
50 first side wall of 42
52 second side wall of 42
54 back wall of 42
56 front wall of 42
58 top wall of 42
60 chamber in 42
61 gasket seal seat
62 shaft for 48
64 first flange on 16
66 bolt
68 second flange on 18
70 actuating lever
71 moving mechanism
72 elongated cable
74 dashboard in 12
76 control knob on 72
78 electric actuator for 71
80 hydraulic actuator for 71
82 air actuator for 71

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved exhaust cutout device for an engine having a collector pipe from a header and an exhaust pipe to a muffler which comprises:

a) means for diverting exhaust gases comprising a box-shaped housing including a first side wall having an inlet port to said exhaust pipe, a back wall extending between said first and second side walls, a front wall extending between said first and second side walls, and a top wall extending over said first side wall, said second side wall, said back wall and said front wall forming a chamber therein with a rectangular open bottom;

b) means for fluidly coupling said diverting means between the collector pipe and the exhaust pipe comprising a first mounting component on the collector pipe connected to said housing at said inlet port and a second mounting component on the exhaust pipe connected to said housing at said outlet port;

c) a rectangular frame mounted on said housing surrounding said open bottom and attached to said housing by a plurality of fasteners and a gasket seal surrounding said open bottom sandwiched between said frame and the edge of said open bottom;

d) said means for diverting including a diverter plate within said housing and means for pivoting said diverter plate between a first operable position down against said gasket seal sealing off said open bottom permitting said exhaust gases to pass through said housing into said exhaust pipe to said muffler and a second operable position pivoted away from said open bottom blocking access to said exhaust pipe and diverting said exhaust gases to bypass said muffler exiting directly into the atmosphere for open road, racing purposes and country driving, when more speed, more power, and better gas economy are required;

e) said pivoting means including a shaft extending through a lower corner of said back wall, one side of said diverter plate and said front wall adjacent said second side wall of said housing;

f) means for operating said diverting means comprising a lever connected at a first side to one end of said shaft, an elongated cable extending from a second side of said lever to a dashboard, and means at the other end of said cable for remotely sliding said cable in and out to operate said diverter plate; and g) said first mounting component including a first flange secured to an end of the collector pipe and a plurality of bolts to extend through said first flange and into said first side wall of said housing, and said second mounting component including a second flange secured to an end of the exhaust pipe and a purity of blots to extend through said second flange and into said second side wall of said housing.

* * * * *